United States Patent [19]

Pater et al.

[11] 4,010,849

[45] Mar. 8, 1977

[54] NESTABLE ARTICLE SHIPPING RACK HAVING PIVOTALLY MOUNTED END RESTRAINTS

[75] Inventors: Walter E. Pater, New Kensington; James R. Rowley, Freeport, both of Pa.

[73] Assignee: PPG Industries, Inc., Pittsburgh, Pa.

[22] Filed: Oct. 1, 1975

[21] Appl. No.: 618,609

[52] U.S. Cl. ..... 206/448; 105/367; 206/451; 206/454; 214/10.5 R; 248/119 R

[51] Int. Cl.[2] ..... B65D 85/48

[58] Field of Search ..... 206/386, 448, 449, 451, 206/454, 386, 521; 214/10.5 R; 105/367, 392.5, 474, 486, 496; 248/119 R

[56] References Cited

UNITED STATES PATENTS

| | | | |
|---|---|---|---|
| 3,147,860 | 9/1964 | Kean, Sr. et al. | 206/448 |
| 3,533,502 | 10/1970 | Hansen | 206/386 |
| 3,623,688 | 11/1971 | Ansund | 248/119 R |
| 3,658,011 | 4/1972 | West et al. | 105/367 |
| 3,809,234 | 5/1974 | Kurick | 206/448 |
| 3,863,799 | 2/1975 | Thomaswick | 206/448 |
| 3,878,942 | 4/1975 | Hansen et al. | 206/454 |
| 3,938,660 | 2/1976 | Moehring | 206/451 |
| 3,939,780 | 2/1976 | Bundy | 206/451 |

*Primary Examiner*—William Price
*Assistant Examiner*—Bruce H. Bernstein
*Attorney, Agent, or Firm*—Donald Carl Lepiane

[57] ABSTRACT

A nestable article shipping rack of the type having a backwall secured to a base includes back supports pivotally mounted on the backwall for movement into and out of the backwall, end restraints pivotally mounted on the base for movement into and out of the base, article edge supports slideably mounted on the base for movement toward and away from the backwall; and front standards pivotally mounted to the base for vertical and horizontal displacement.

19 Claims, 10 Drawing Figures

NESTABLE ARTICLE SHIPPING RACK HAVING PIVOTALLY MOUNTED END RESTRAINTS

RELATED APPLICATIONS

The bottom edge support taught in U.S. patent application Ser. No. 618,607 filed even date in the names of James R. Rowley and Stephen R. Sokol and entitled "Bottom Edge Support for an Article Shipping Rack" may be used in the practice of the invention. The teachings of the above-identified application are hereby incorporated by reference.

BACKGROUND OF THE INVENTION

1. Field of the Invention

This invention relates to nestable article shipping racks and end restraints for limiting longitudinal motion of the articles.

2. Discussion of the Technical Problems

Articles, e.g., glass sheets, automotive sidelites or automotive windshields are transported in racks. In general, the racks include a backwall having back supports secured to a base having edge supports to support the articles on an edge tilted toward the backwall. This arrangement provides stacking stability and counteracts transportation oscillating forces that oscillate the articles about their bottom edge toward and away from the backwall.

Transportation longitudinal forces which move the articles toward and away from the sides of the rack are dampened by end restraints mounted on the base.

After the racks are unloaded, they are stored for return shipment. Because the end restraints extend beyond the base and the back supports extend out from the backwall the racks are not nestable. In other words, individual racks cannot be stacked within other racks. As can be appreciated, cost of shipping empty racks by rail or truck and the storage of empty racks is reduced when racks are nestable. This is because more empty racks can be shipped in a railcar, truck and/or stored.

Another limitation of the prior art racks is the force absorbing facilities of the end restraints. Typical prior art end restraints are taught in U.S. Pat. Nos. 3,147,860 and 3,809,234. In general the end restraint of U.S. Pat. No. 3,809,234 includes a saddle that is mounted on a pair of stationary inclined mounting fixtures. One drawback is that the end restraints are not economically adaptable for different article edge contours. The matching of the contour of the engaging surface of the edge restraint to the article edge contour is critical because a mismatch can set up areas of point stress that can fracture the article edge during transit. In the prior art, the mismatch problem can be eliminated by providing various end restraints for the various article edge contour of the articles to be shipped. This is expensive from an inventory standpoint.

Another drawback of the prior art end restraints is that the force of the articles is absorbed by direct contact with the rubber pad of the saddle. Directly absorbing the force by the rubber pad requires that the saddle and mounting fixture be structurally strong. Increasing the structural strength of the end restraints increases the weight of the rack and the cost to fabricate the rack.

Therefore, it would be advantageous if nestable racks were available to reduce the cost of returning empty racks to the supplier and storing empty racks. Further it would be advantageous if an end restraint was available that does not have the limitations of the prior art end restraints.

SUMMARY OF THE INVENTION

This invention relates to an improved end restraint for an article shipping rack of the type having a base. The end restraint includes a rigid plate mounted on a rigid member that is pivotally mounted on the base for movement into and out of the plane of the base. Biasing facilities act on the rigid member to urge the rigid member toward the base when the biasing facilities are compressed.

This invention also relates to a nestable rack having the end restraints of the invention and back support facilities pivotally mounted on a backwall secured to the base. The back support facilities pivot about a plane parallel to the back, toward and away from the backwall.

DESCRIPTION OF THE INVENTION

Figure 1:
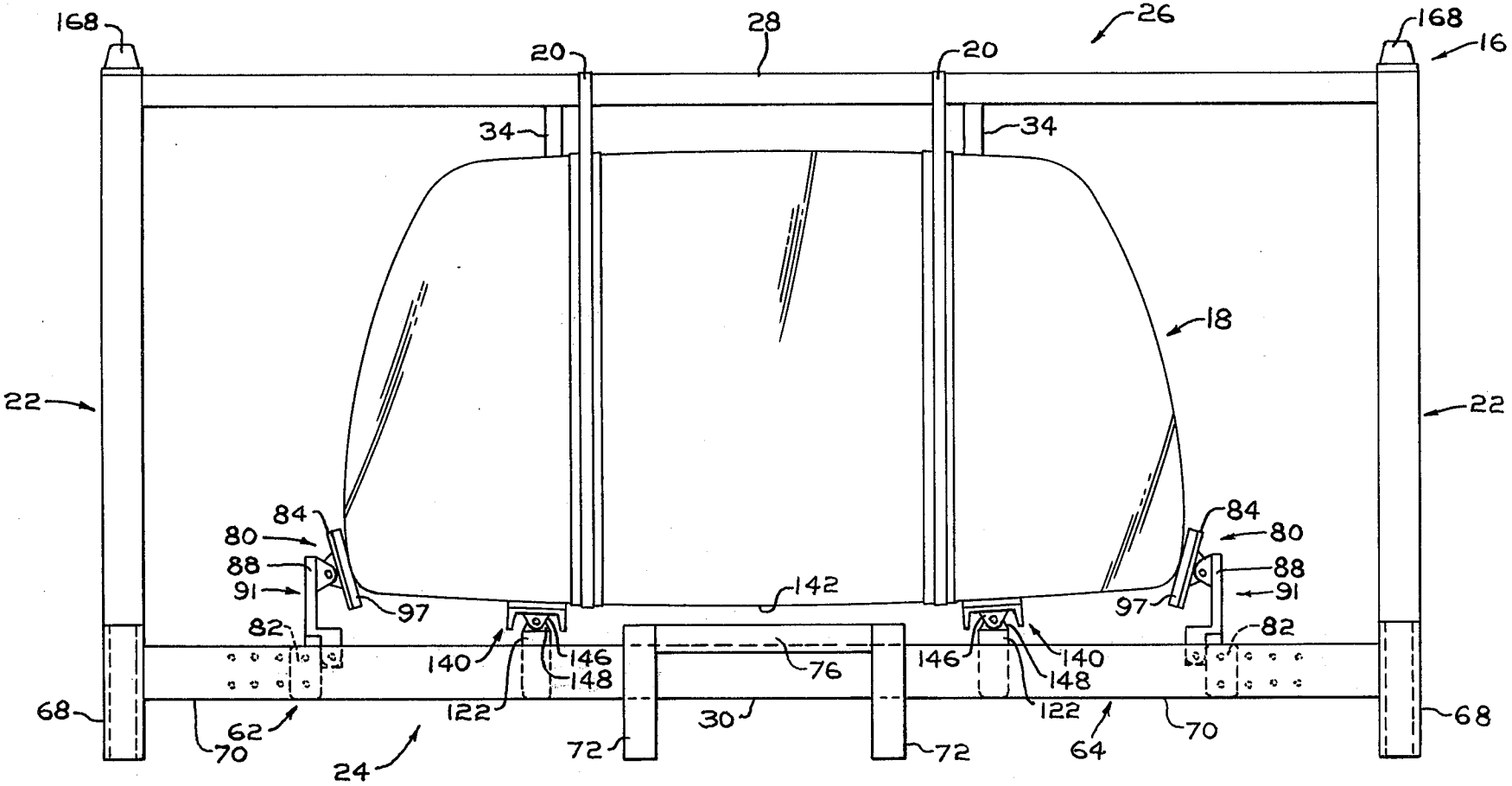
FIG. 1 is a front view of a loaded article shipping rack incorporating features of the invention.

Referring to FIG. 1, there is shown rack 16 incorporating features of the invention having a plurality of articles 18 secured therein in any conventional manner, e.g., by banding 20.

Figure 2:
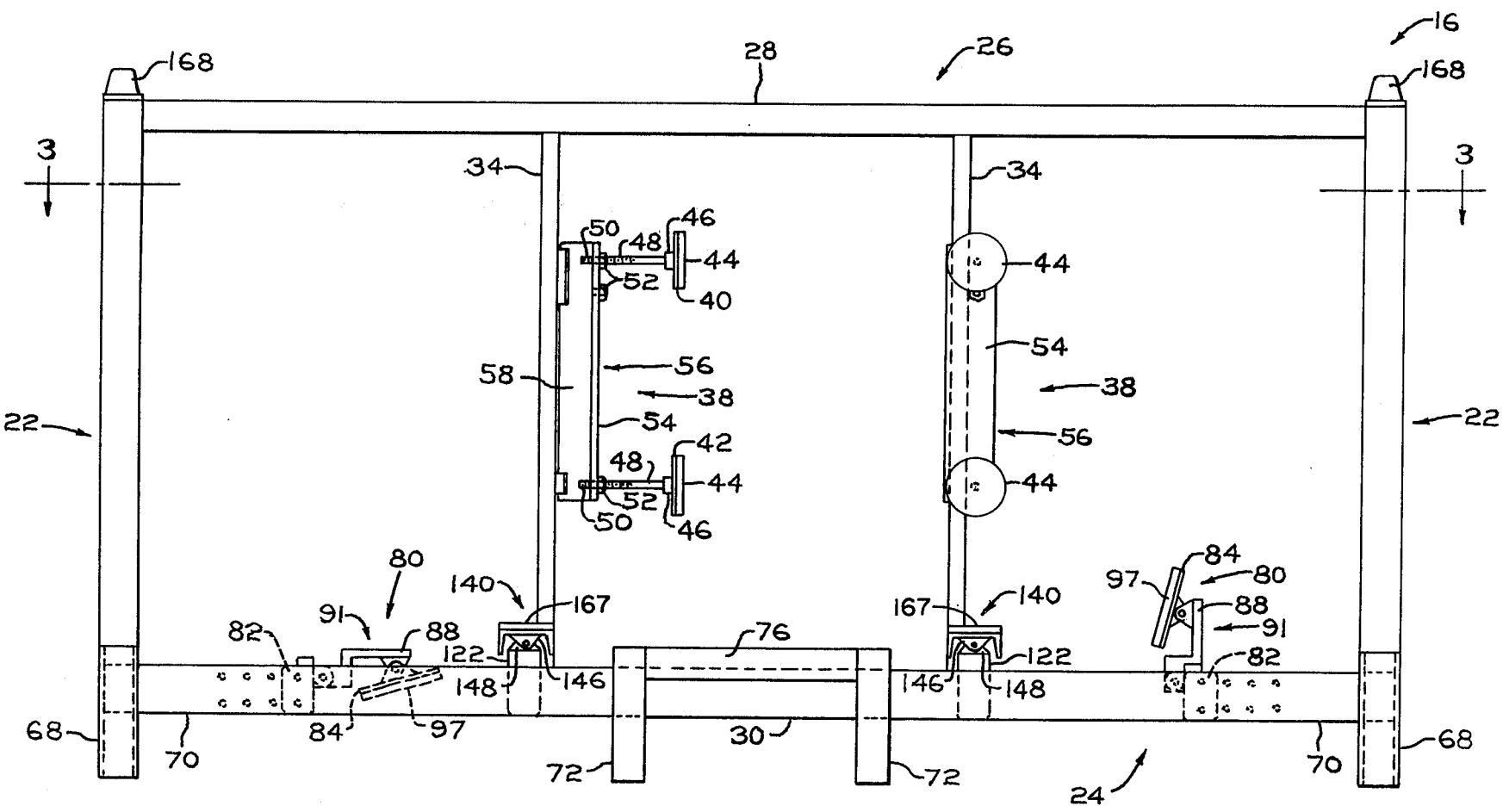
FIG. 2 is a front view of the article shipping rack of FIG. 1 having left back support and left end restraint positioned for nesting of the rack.
Figure 3:
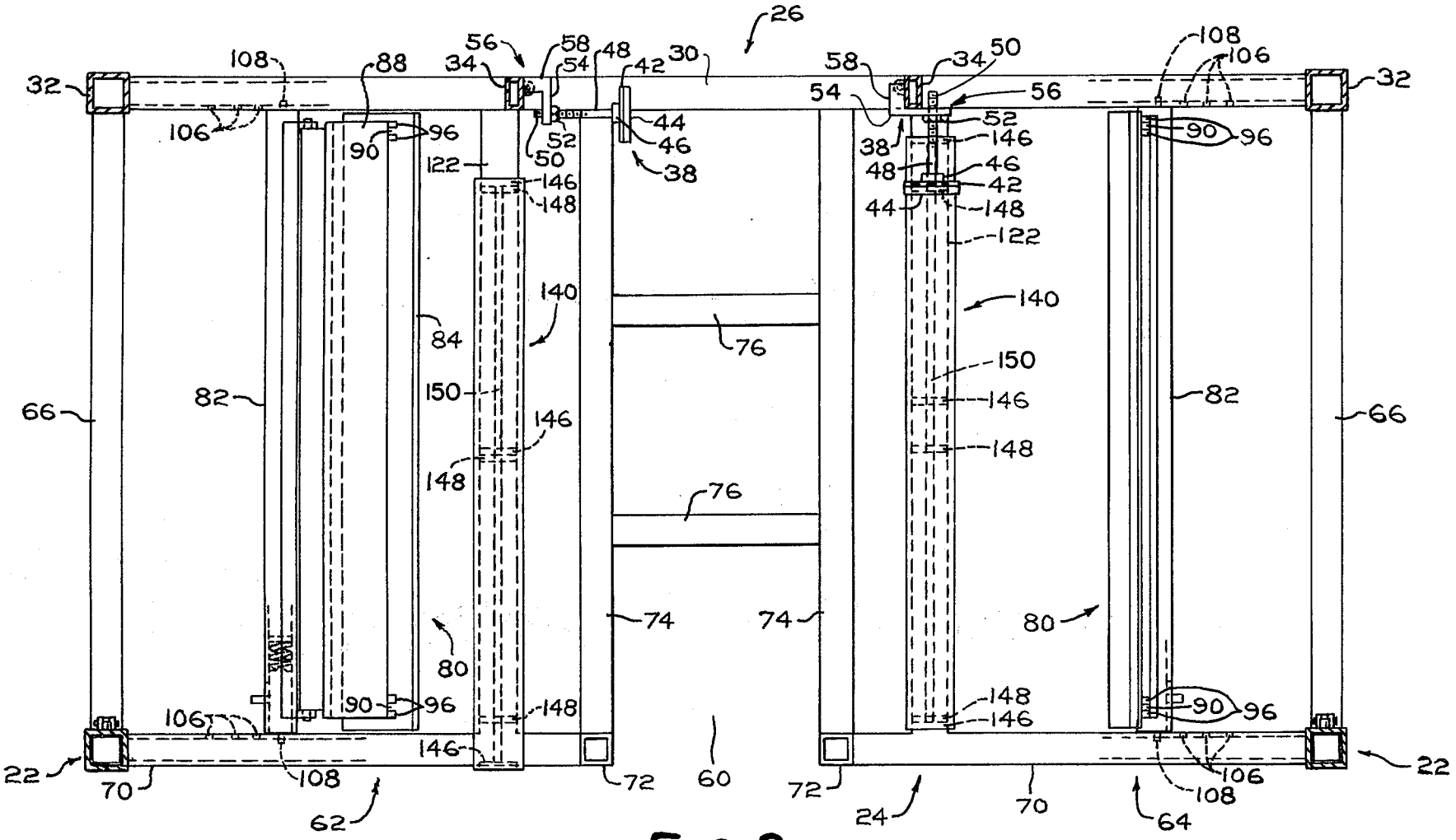
FIG. 3 is a top view of the rack of FIG. 2 having portions removed for purposes of clarity.

With reference to FIGS. 2 and 3, the rack 16, in general, includes a pair of front standards 22 pivotally mounted to base 24 and a backwall 26 secured to the base.

The backwall 26 is defined by upper and lower longitudinal members 28 and 30 respectively secured at their ends to back standards 32 and vertical cross members 34 and secured in spaced relation between the longitudinal members 28 and 30. Back supports 38 are pivotally mounted to the vertical cross members 34, to support the articles 18 in a generally vertical position.

In general, each of the back supports 38 includes an upper disk or plate 40 and a lower disk or plate 42 each having a pad 44 to prevent marring of the article surfaces and pivotally mounted at 46 on an end of threaded rod 48. The outer end 50 of the threaded shaft is mounted in a nut 52 secured to leg 54 of an "L" shaped member 56. The other leg 58 of the member 56 is pivotally mounted to the vertical cross member 34 in any conventional manner for movement into the plane of the backwall, i.e., the nesting position as shown for the left back supports in FIGS. 2 and 3 and for movement over the base, i.e., the load position as shown for the right back supports in FIGS. 2 and 3.

The disks 42 are preferably mounted on the threaded shaft 48 to maximize surface contact between the rubber pad 44 and the engaged surface of the articles 18 for various surface contours of the articles. Further, using threaded shafts provides for various tilt angles of the articles for packing stability.

As shown in FIG. 2, an additional nut 52 is mounted on the upper portion of the member 56 to accommodate various article heights thereby minimizing bending force acting on the top edge of the articles (shown in FIG. 1).

The back supports 38 are not limiting to the invention but are merely presented as types of back supports preferred in the practice of the invention.

With reference to FIG. 3, the base 24, in general, has a rectangular shape with a cut out portion 60 at its front end to facilitate loading of the articles 18 in the rack 16. For ease of discussion, the base is considered to include a left base portion 62 and a right base portion 64 which are identical in construction. Each of the base portions include an outer lateral member 66 mounted between back standard 32 and leg 68 of the front standard 22; (shown better in FIG. 4); a front longitudinal member 70 mounted between the leg 68 of front standard 22 and support leg 72 and inner lateral member 74 mounted between the support leg 72 and the lower longitudinal member 30.

A pair of cross struts 76 are mounted in spaced relation between the inner lateral members 74 of the base portion 62 and 64 for structural stability.

As will become apparent, the invention is not limited to the configuration of the base and the base discussed, above is merely presented for illustration purposes only.

With continued reference to FIGS. 2 and 3, and end restraint 80 incorporating features of the invention is pivotally mounted on cross member 82. The member 82 is mounted between front longitudinal member 70 and lower longitudinal member 30 for reciprocal longitudinal movement, i.e., reciprocal movement along a path parallel to the backwall 26 of the rack 16.

Figure 5:
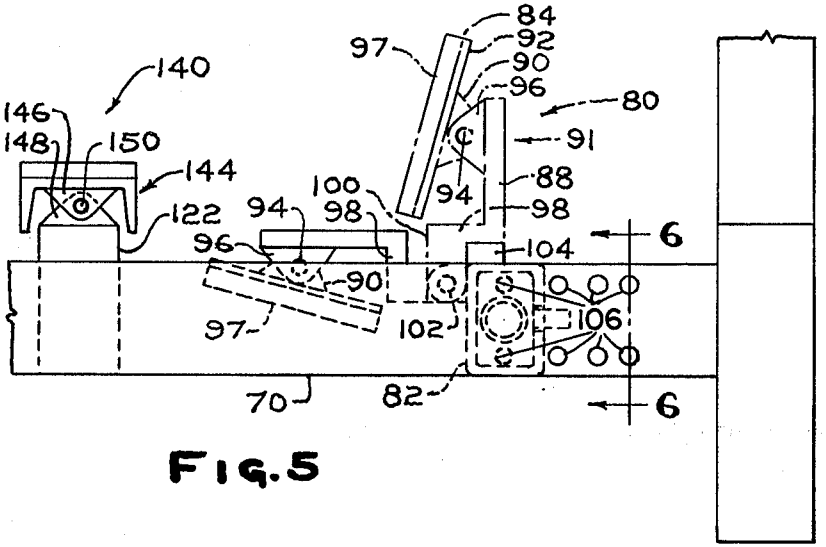
FIG. 5 is an enlarged view of the right end restraint of the rack shown in FIG. 1 illustrating the load position and nesting position.

With reference to FIGS. 3 and 5, the end restraint 80 includes a rigid plate 84 pivotally mounted in any conventional manner, to leg portion e.g., a first rigid plate member 88 of member 91 to accommodate various edge contours of the articles 18. For example, a pair of spaced plates 90 (one shown in FIG. 5) are mounted on surface 92 of the plate 84 which plates 90 are pivotally mounted by way of pin 94 to plates 96 secured to the leg 88 of member 90 (shown better in FIG. 3). A resilient pad 97 is provided on the plate 84 to prevent marring of the article edges.

The member 91 further includes an intermediate leg portion intermediate rigid plate member 98 secured at one side to the leg portion 88 and at the other side to leg portion e.g. a second rigid plate member 100. The leg portion 100 is pivotally mounted at 102 to cross member 82 for movement into and out of the plane of the base 24.

In the load position the intermediate leg 98 of the member 90 extends over the cross member 82 with the leg portion 88 in a generally vertical position as shown in FIG. 5. Positioned between the intermediate leg portion 98 and cross member 82 is biasing facilities 104. The biasing facilities, e.g., a rubber pad may be adhered to the cross member 82 or leg portion 88.

During transit, the articles 18 are subjected to longitudinal forces that move the articles along a reciprocating path generally parallel to the backwall, i.e., a reciprocating longitudinal path, against the end restraints 80.

The force of the article pivots the end restraint 80 about the cross member 82 to compress the pad 104. The pad 104 absorbs the shock and as the articles move away from one end restraint member toward the other, the resilient pad 104 urges the end restraint toward the articles. In this manner, the end restraint absorbs the forces acting on the articles while maintaining the end restraint in engagement with the articles.

In the prior art, e.g., U.S. Pat. No. 3,809,234, the end restraints are secured in position against the edge of the articles. These types of end restraints have drawbacks, one of which is that the force moving the articles toward the end restraint is absorbed by the articles. The end restraint of the instant invention eliminates this drawback by pivotally mounting the end restraint on the cross member 82. This is because the displacement of the end restraint decreases the force to be absorbed by the end restraint which in turn decreases the force absorbed by the articles. Another advantage of the end restraint of the invention is the matching of the end restraint to the contour of the edges of the articles to eliminate point contact stress. This is accomplished by pivotally mounting the plate 84 on the member 90 as shown in FIG. 5. As can be appreciated by those skilled in the art, point contact stress can fracture the articles especially glass articles.

When the racks are to be nested in a manner to be discussed below, the end restraint 80 is pivoted about 102 and drops into the base as shown in FIGS. 2 and 5.

The cross member 82 is movably mounted on the base 24 in any conventional manner to accommodate various article lengths.

Figure 6:
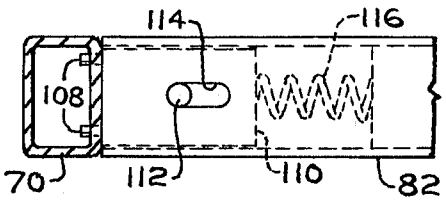
FIG. 6 is a partial view taken along lines 6—6 of FIG. 5.

For example and with reference to FIGS. 3, 5 and 6, the front longitudinal member 70 and lower longitudinal member 30 are each provided with a plurality of spaced holes 106 for receiving studs 108 provided on the ends of the cross member 82. The studs 108 on one side of the cross member 82 are retractable for ease of positioning the cross member on the base.

One expedient of slideably mounting the studs 108 is shown in FIG. 6. The studs 108 are mounted on a block 110 slideably mounted in the cross member 82. A shaft 112 connected to the block 110 slides in groove 114 for moving the block 110 into the cross member 82 against the biasing action of a spring 116.

Figure 7:
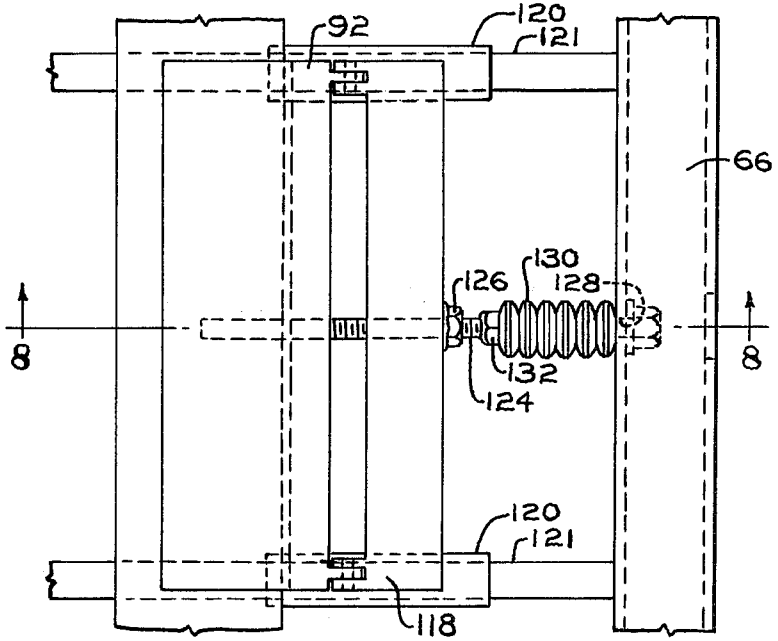
FIG. 7 is a top partial view of an alternate embodiment of the end restraint of the invention.
Figure 8:
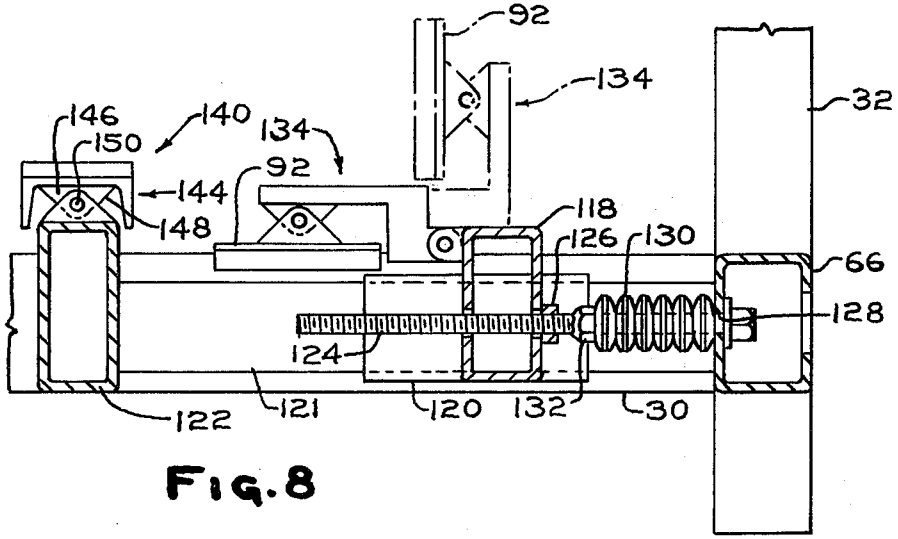
FIG. 8 is a view taken along lines 8—8 of FIG. 7.

Referring to FIGS. 7 and 8, there is shown another expediency that may be used to move the end restraint 80 along the base and is of the type taught in U.S. patent application Ser. No. 488,346 now U.S. Pat. No. 3,961,709 filed July 15, 1974, in the name of James R. Rowley and entitled "End Restraint for Shipping Bins". The teachings of the above-identified application are hereby incorporated by reference.

In general, a cross member 118 similar to the cross member 82 are slideably mounted on guideways 121 second between outer lateral member 66 and inner lateral member 122. A threaded shaft 124 has one end threaded into nut 126 mounted on the cross member 118 and the other end slideably mounted in the outer lateral member 66 by way of hole 128 as taught in the above-identified U.S. patent application Ser. No. 488,346. Rotating the shaft 124 in a first direction moves the cross member 118 toward the articles and rotating the shaft 124 in a second direction moves the cross member 118 away from the articles.

A spring 130 mounted on the shaft 136 between member 66 absorbs the force acting on the articles and maintains the end restraint in engagement with the articles in a manner taught in the above-identified U.S. patent application Ser. No. 488,346.

In operation, movement of the end restraint toward the outer lateral cross member 66 compresses the spring 130 to dampen the forces acting on the articles. As the articles move away from the end restraint, the spring 130 urges the end restraint toward the article to maintain the end restraint in contact with the articles.

In the embodiment shown in FIGS. 7 and 8, the plate 92 is pivotally mounted to an L-shaped member 134 which in turn is pivotally mounted to the cross member 118 as shown in FIG. 8. In the embodiment of FIGS. 7 and 8, the resilient pad 104 (see FIG. 5) is not shown as the spring 130 acts to absorb the shock as discussed above.

In another embodiment (not shown) the spring 130 may be replaced by the resilient strip 104 provided between the member 118 and the intermediate leg portion 98 of the member 90 as shown in FIG. 5. In this instance, the end of the threaded shaft 124 is preferably mounted to the outer lateral member 66 only for rotational movement.

The discussion will now be directed to bottom edge supports 140 that support bottom edge 142 of the articles 18, as shown in FIG. 1, to ship the articles in a generally vertical position.

The edge support 140 used in the practice of the invention may be any of the type used in the art but preferably are of the type taught in U.S. patent application Ser. No. 618,607 filed even date in the names of James R. Rowley and Stephen R. Sokol and entitled "Bottom Edge Support for an Article Shipping Rack" with teachings are hereby incorporated by reference.

In general, and with reference to FIGS. 3 and 5, each of the bottom edge supports 140, in general, includes an inverted U-shaped channel member 144 pivotally and slideably mounted to the cross member 122 in any conventional manner. For example, a plurality of plates 146 are secured in spaced relation within the U-shaped member as shown in FIG. 3 and a plurality of plates 148 are mounted on the cross member 122. A rod 150 extends through the plates 146 and 148 to pivotally mount the U-shaped member 144 to the cross member 122 to accommodate various edge contours.

The plates 146 and 148 are positioned on the U-shaped member 144 and cross member 122, respectively, such that the U-shaped member 144 may be displaced away from the backwall when the racks are nested.

Figure 4:
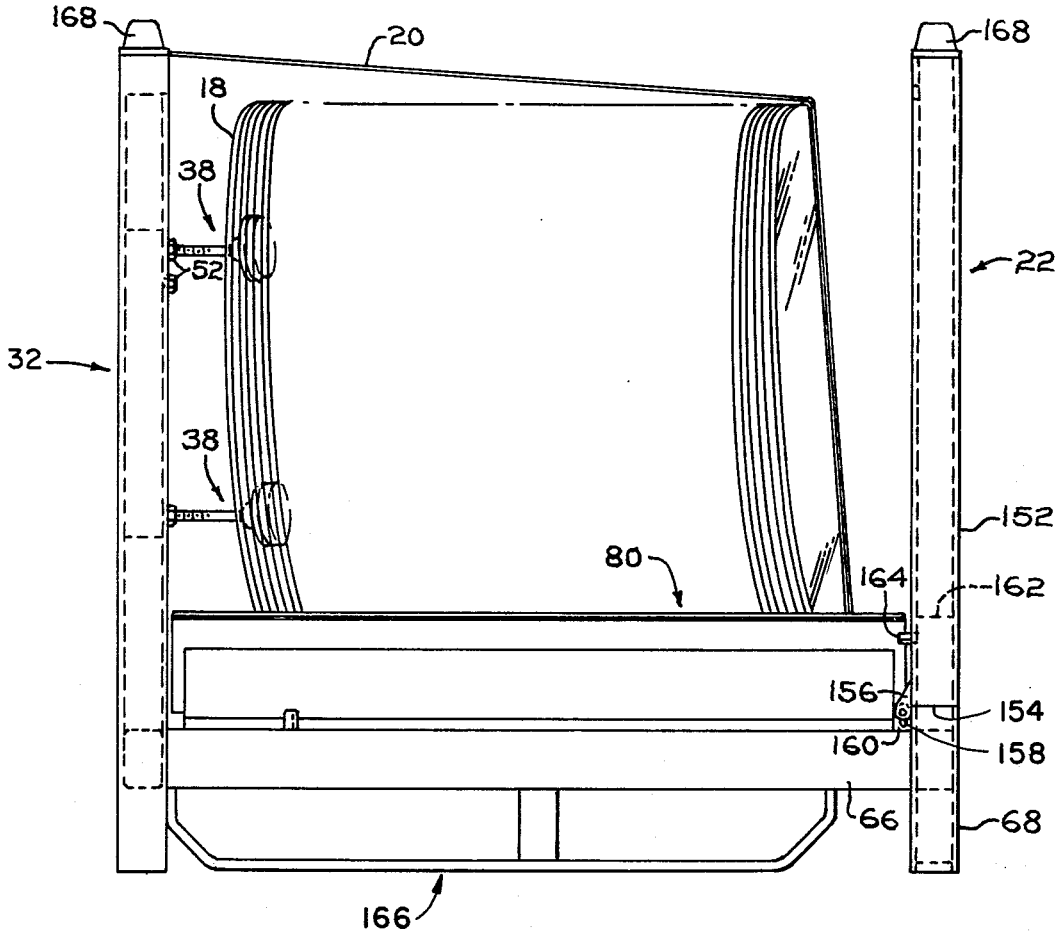
FIG. 4 is a right side view of the rack of FIG. 1.
Figure 9:
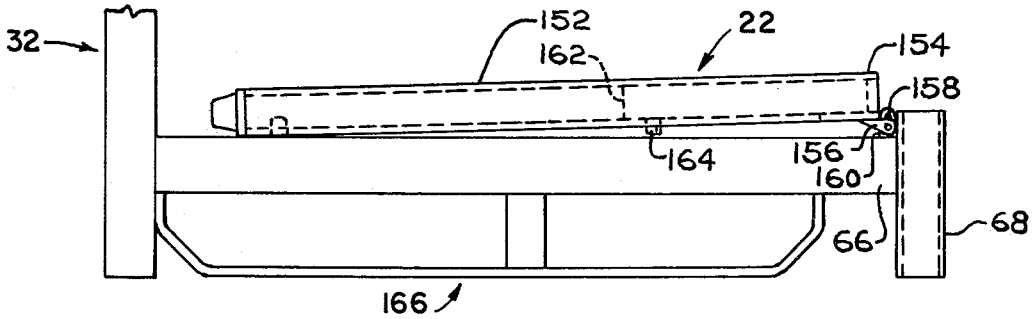
FIG. 9 is a partial left side view of the rack of FIG. 2 showing the front left standard in the nesting position.

Referring to FIGS. 4 and 9, the discussion will be directed to the pivotal front standards 22. The front standards 22 each include an upright 152 pivotally mounted at end 154 to the leg 68 for dropping the upright 152 on cross member 66 when the racks are to be nested or stacked.

The end 154 of the upright 152 is provided with a bifurcated member 156 slideably mounted in groove 158 of member 160 by way of a pin. The member 160 is secured to the cross member 66 and/or leg 68. Slideably mounted within the uprights 152 is a telescoping member 162. The upright 152 is held in the vertical position as viewed in FIG. 4 by the member 162 which extends into the leg 68. The upright is lowered by raising lever 164 upward as shown in FIG. 4 in a groove (not shown) to move the member 162 out of the leg 68.

Figure 10:
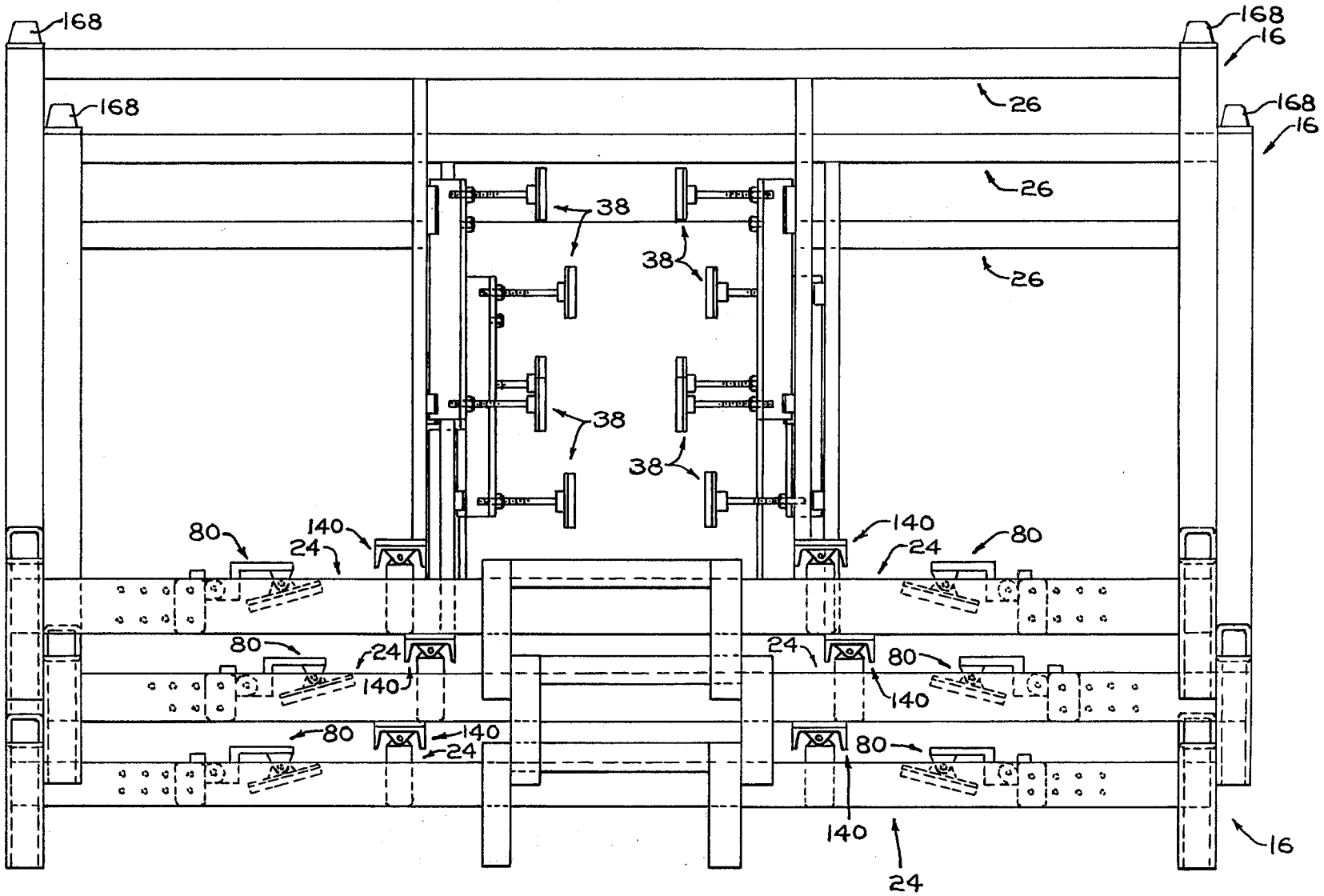
FIG. 10 is a front view of a plurality of racks of the invention nested one on top of the other.

Referring now to FIG. 10, there is shown a front elevated view of three racks incorporating features of the invention nested one on top of the other. In the nesting position the back supports 38 are in the plane of the backwall 26 and the end restraints 80 are dropped toward the base 24. The bottom edge supports 140 are moved away from the backwall 26 as shown for the left bottom edge support in FIG. 3. The lower longitudinal member 30 and front longitudinal members 70 are supported on the bottom edge supports 140. The upright 152 rests on the outer lateral member 66 as shown in FIG. 9.

The invention is not limited to the embodiments discussed and other expediencies may be used within the scope of the invention.

DETAILED DESCRIPTION OF THE INVENTION

The rack incorporating features of the invention will be used to ship 70 automotive windshields each about ¼ inch (0.64 centimeter) thick laminates and having a compound contour. The height of each article is about 30 inches (0.75 meter) and the width at their bottom edge 142 is about 60 inches (1.5 meters).

Referring to FIGS. 2 and 3, backwall 26 of the rack 16 includes an upper and lower longitudinal member 28 and 30, respectively, mounted between back standards 32 and each made of 2 inch (5.08 centimeters) 11 gauge steel tubing about 67 inches (1.7 meters) in length. The back standards 32 are about 47 inches (1.2 meters) and made of 2½ inch (6.4 centimeters) square 11 gauge steel tubing.

A pair of vertical members 34 are mounted between the members 32 and 34. Each of the cross members are about 37 inches (0.9 meter) in length and made of 1 × 2 inch (2.54 × 5.08 centimeters) 11 gauge steel tubing. The cross members 34 are on a center-to-center spacing of about 25 inches (0.6 meter) and a center-to-center spacing with adjacent back standards 32 of about 22 inches (0.59 meter).

With specific reference to FIG. 2 back supports 38 are pivotally mounted on the backwall 28. Each back support includes an L-shaped steel plate 56 about 28¾ inches (8.7 meters) in length, about ¼ inch (0.63 centimeter) thick, a leg 54 about 3 inches (7.12 centimeters) wide and a leg 58 about 1½ inches (3.56 centimeters) wide. The leg 58 is pivotally mounted to the cross member 34 in any conventional manner. A pair of threaded shafts 48 each about 6 inches (15.24 centimeters) in length and about ½ inch (1.27 centimeters) thick has one end threaded into nut 52 mounted on the leg 54 of plate 56. A steel disk about 4 inches (10.16 centimeters) in diameter and about ¼ inch (0.63 centimeter) thick is pivotally mounted on end of the shaft 48. A rubber pad 44 about ½ inch (1.27 centimeters) thick is mounted on the outer surface of the disk 40 to prevent marring of the glass surface.

The lower disk 42 is on a 7 inch (17.78 centimeters) center-to-center spacing with the lower longitudinal member 30 and the upper disk 40 is on a 31 inch (0.7 meter) center-to-center spacing with the member 30.

Referring to FIG. 3, base 26 is outlined by the lower longitudinal member 30, outer lateral members 66, front longitudinal members 70, inner lateral members 74 and cross struts 76. The outer lateral members 66 are mounted between the back standards 32 and leg 68 of the front standard 22 (see FIG. 4). Each of the members 66 are made of 2 inch (5.08 centimeters) square 11 gauge steel tubing about 39 inches (0.98 meter) in length. The front longitudinal members 70 are mounted between the leg 68 of the front standard and support leg 72 as shown in FIG. 2. Each of the members 70 are made of 2 × 3 inch (5.08 × 7.62 centimeters) 11 gauge steel tubing about 19 inches (0.48 meter) in length. The support legs 72 are made of 2½ inch (6.4 centimeters) square 11 gauge steel tubing about 8⅜ inch (21.3 centimeters) in length.

The inner lateral members 74 are mounted between the support legs 72 and the lower longitudinal cross member 30. Each of the members are made of 2 × 4 inch (5.08 and 10.16 centimeters) 11 gauge steel tubing about 39 inches (0.98 meter) in length.

The cross struts 76 are on a center-to-center spacing of about 6¼ inches (15.9 meters) and about 22 inches (55.9 centimeters) with the lower longitudinal member 30. Each of the struts 76 are made of 2 inch (5.08 centimeters) square 11 gauge steel tubing about 25 inches (63.5 centimeters) in length.

With reference to FIG. 4, the base 24 is spaced about 7 inches (17.78 centimeters) above the floor.

A stabilizer bar 166 of the type used in the art is attached to undersurface of each of the outer lateral members 66.

As shown in FIGS. 2 and 3, a pair of end restraints 80 and bottom edge supports 140 are provided on the base 24. With specific reference to FIGS. 3 and 5, each of the end restraints are pivotally mounted on a longitudinally moveable cross member 82.

The end restraints include a steel plate 84 about ¼ inch (0.63 centimeter) thick, about 37 inches (0.9 meter) in length and about 6 inches (15.24 centimeters) wide. A ½ inch (1.27 centimeters) thick rubber pad 97 having a durometer reading of about 60 is mounted on a major surface of the plate to prevent marring of the glass edges. The opposite major surface of the plate has a pair of ⅜ inch (0.96 centimeter) thick gussets 90 spaced about 24 inches (0.6 meter) apart. The gussets 90 are pivotally mounted to gussets 96 mounted on leg portion 88 of member 91 by way of ½ inch (1.27 centimeters) pin 94.

The member 91 is about ½ inch (0.63 centimeter) thick, and about 26½ inch (0.65 meter) in length and includes the leg portion 88 which is also about 3 inches (7.62 centimeters) in width; intermediate leg portion 98 which is about 2 inches (5.08 centimeters) wide and outer leg portion 100 which is 1¾ inches (4.4 centimeters) wide.

The leg portion 100 is pivotally mounted to the cross member 82 at 102 such that when the leg portion 88 is in the vertical position as viewed in FIG. 5, the distance between adjacent surfaces of the intermediate leg portion 98 and the cross member 82 is about ½ inch (1.27 centimeters).

A rubber pad 104 is secured to the cross member or the intermediate leg portion 98. The rubber pad is about ½ × 1 × 26½ inches (1.27 × 2.54 × 67.3 centimeters).

With reference to FIGS. 3 and 6, the cross member 82 is made of 2½ inch (6.4 centimeters) square 11 gauge steel tubing about 35 inches (0.89 meter) in length. The top end of the cross member 82 has a pair of ½ inch (1.27 centimeters) 1 inch (2.54 centimeters) long studs that are received in holes 106 of the lower longitudinal member 30. The other end of the cross member 82 as shown in FIG. 6 includes a block 2 inch square (5.08 centimeters) square block 110 captured in the end of the member 82 by shaft 112 extending out of groove 114 and biased out of the cross member 82 by spring 116. Studs 108 on the block 110 are seated in holes provided on the front longitudinal members 70.

In this manner, the cross member can be positioned on the base about the articles 18.

The right end restraint 82 as viewed in FIG. 3 is positioned about 6 inches (13.2 centimeters) from the adjacent outer lateral member 66. The left end restraint is not moved into position until the articles are loaded.

The bottom edge supports 140 are of the type taught in the above-mentioned U.S. patent application filed even date. With reference to FIGS. 2 and 3, each of the bottom supports 140 include an inverted C 3 × 4.1 channel American Standard about 35 inches (0.94 meter) in length pivotally mounted to a 2½ inch (6.35 centimeters) square inner lateral member 122. The member 122 is secured between front longitudinal member 70 and lower longitudinal member 30 spaced about 12 inches (0.3 meter) from adjacent outer lateral member 66.

A rubber pad 161 having a thickness of ½ inch (1.27 centimeters) is mounted on the upper surface of the member 144 to prevent marring the glass edges.

The member 144 is pivotally and slideably mounted to the member 122 by providing ½ inch (1.27 centimeters) thick steel plates 146 at each end of the member 144, a plate 146 between the outer plates and three steel ½ inch (1.27 centimeters) steel plates on the member 122 spaced 6 inches (15.2 centimeters), 23½ inches (0.6 meter) and 35 inches (0.9 meter) from the inner surface of the lower longitudinal member 30. A rod 150 passes through each of the plates of the member 144 and cross member 122.

Referring now to FIGS. 4 and 9, the discussion will be directed to the collapsible front standards 22 incorporating features of the invention. Each of the front standards 22 includes an upright 152 made of 2½ inch (6.35 centimeters) 11 gauge steel tubing about 38⅝ inches (1.0 meters) in length. The bottom end of the upright 152 as viewed in FIG. 4 is pivotally and slideably mounted by way of a bifurcated member 156 captured in a groove 158 of member 160 secured to the outer lateral member 66 as shown in FIGS. 4 and 9. A telescoping member 162 made of 2 inch (5.08 centimeters) square 11 guage steel tubing about 12 inches (0.3 meter) in length is captured in the lower end by way of lever 164 extending out of a groove (not shown) in the wall of the upright 152. In the vertical position, the member 162 extends about 6 inches (15 centimeters) into the leg 68 to maintain the upright in the vertical position. A male member 168 is provided on each of the back and front standards 32 and 33 for stacking loaded rack.

Referring to FIG. 1, the rack 16 is loaded by positioning the bottom edge 142 of the windshield 18 on the bottom edge supports 140 against the right end restraint 80 and supporting the windshields in the vertical position by the back supports 38. Each of the windshields are separated in any conventional manner, e.g., by corrugated fiberboard to prevent marring of adjacent surfaces.

After the windshields are loaded, the left end restraint is moved against the edges of the windshields and secured in place as previously discussed. The windshields are secured in the rack 16 in any conventional manner as by banding as shown in FIG. 1. The uprights 152 are then moved to the vertical position. The rack is now ready for shipment and/or storage.

During shipment, the longitudinal forces acting on the articles are absorbed by the end restraints in the following manner. The articles are urged against an end restraint, e.g., the right edge restraint as viewed in FIG. 1, by the transportation force to move the member 91 in a clockwise direction as viewed in FIG. 4. The intermediate leg portion 98 is urged against the rubber pad 104. As the articles are shifted in the opposite direction or left direction as viewed in FIG. 1 by the transportation forces, they move against the other end restraint. The rubber pad 104 urges the member 92 counterclockwise as viewed in FIG. 4 to maintain the edge restraint against the articles.

Point contact stress acting on the edge of the windshields as they engage the end restraints is eliminated by the plate 92 pivotally mounted on the member 134. More particularly the plate 92 of the end restraint pivots to seat itself against the edges of the articles.

The windshields are unloaded from the rack in the reverse manner in which they were loaded.

The racks are nested by lowering the uprights 152 onto the lateral cross members 66 (shown in FIG. 9) moving the back supports 38 into the plane of the backwall 26 as shown for the left back supports in FIGS. 2 and 3, and lowering the end restraints into the plane of the base as shown for the left end restraint in FIG. 2. The bottom edge supports 140 are moved away from the backwall 26.

Referring to FIG. 10, the lower longitudinal member 30 and front longitudinal member 70 are engaged by the bottom edge supports 140 to support the rack. The racks are nested as shown in FIG. 10.

As can be appreciated, the invention is not limited to the above discussion, and that the discussion was presented for illustration purposes only.

What is claimed is:

1. In a rack for shipping articles wherein the rack is of the type having a base and a pair of end restraint means mounted in opposed spaced relationship on the base to limit longitudinal motion of the articles to be shipped, the improvement comprising:

each of the end restraint means comprising:

a rigid member pivotally mounted to the base for movement in a first direction toward the plane of the base and in a second opposite direction away from the plane of the base;

a rigid plate mounted on said rigid member; and biasing means mounted between the base and said rigid member as it moves in the second direction, said biasing means responsive to the movement of said rigid member as it moves in the second direction to urge said rigid member in the first direction.

2. The improved rack as set forth in claim 1 wherein said rigid member includes:

a first rigid plate member;

means for pivotally mounting said first plate member to the base;

a second rigid plate member;

an intermediate plate member secured to said first and second plate members; and said rigid plate mounted to said second rigid plate member.

3. The improved rack as set forth in claim 2 wherein said rigid plate has a first surface pivotally mounted to said second rigid plate member of said rigid member; and a resilient pad mounted on the second surface of said rigid plate opposite to the first surface.

4. The improved rack as set forth in claim 3 wherein said biasing means is a resilient pad positioned between said intermediate plate member and the base.

5. The improved rack as set forth in claim 1 wherein the rack is of the type having a backwall secured to the base to ship the articles in a generally vertical position, further comprising:

back support means;

means for pivotally mounting said back support means on the backwall to move toward and away from the backwall about a line generally normal to the base.

6. The improved rack as set forth in claim 5 wherein said back support means includes:

a generally L-shaped member having one leg pivotally mounted to the backwall, said L-shaped member in a first position has the other leg urged against the backwall of the rack.

7. The improved rack as set forth in claim 5 wherein said rigid member of the end restraint means comprises:

a first rigid plate member having a first side and a second side opposite to the first side;

a second rigid plate member having a first side opposite to a second side;

an intermediate rigid plate member secured at a first side adjacent to the second side of said first rigid plate member and its opposite second side secured adjacent to the first side of said second rigid plate member such that the first side of said first rigid plate member and the second side of said second rigid plate member extend in opposed directions to one another;

means for pivotally mounting said second rigid plate member to the base such that in the first position said first rigid plate member is in a generally vertical position; and said rigid plate mounted on said first rigid plate member.

8. The improved rack as set forth in claim 7 wherein the base includes a detachably secured rigid cross member and further including:

said second rigid plate member pivotally mounted to said cross member such that in the first position said intermediate rigid plate member is urged toward said cross member;

said rigid plate having a first surface and a second opposite surface;

means for pivotally mounting the first surface of said rigid plate to said first rigid plate member;

a resilient pad mounted on the second surface of said rigid plate; and said biasing means positioned between said intermediate rigid plate member and said cross member when said rigid member is in the first position.

9. The improved rack as set forth in claim 5 further including a pair of bottom edge supports pivotally mounted on the base in spaced relation to each other.

10. The improved rack as set forth in claim 5 further including:

a pair of front standards pivotally mounted at one end to the base such that in the first position the standards are in a generally vertical position and in a second position the standards lay on the base.

11. The improved rack as set forth in claim 5 wherein the articles are glass.

12. The improved rack as set forth in claim 5 wherein the backwall includes a pair of spaced vertical cross members and a pair of said back support means pivotally mounted on each of the vertical cross members, each of said back support means comprising:

a generally L-shaped member having a first leg and a second leg;

means for pivotally mounting the first leg of said L-shaped member to a one of the vertical cross members, said L-shaped member in a first position has a major surface of the second leg facing its respective vertical cross member;

a shaft having one end mounted to a major surface of the second leg of said L-shaped member;

a plate having a first surface and a second opposite surface; and means for mounting said first surface of said plate on the other end of said shaft.

13. The improved rack as set forth in claim 12 wherein said shaft is a threaded shaft having the one end threaded into the second leg of said L-shaped member, and a resilient pad mounted on the second surface of said plate.

14. The improved rack as set forth in claim 13 further including:

a pair of opposed rigid cross members detachably secured to the base;

an end restraint means mounted on each of said rigid cross members, each of said end restraint means comprising:

a first rigid plate member having a first side and a second side opposite to the first side;

a second rigid plate member having a first side opposite to a second side;

an intermediate rigid plate member secured at a first side adjacent to the second side of said first rigid plate member and its opposite second side secured adjacent to the first side of said second rigid plate member such that the first side of said first rigid plate member and the second side of said second rigid plate member extend in opposed directions to one another;

means for pivotally mounting said second rigid plate member to said cross member such that in a first position said first rigid plate member is in a generally vertical position with said intermediate rigid plate member spaced from said cross member;

a first resilient pad between said cross member and said intermediate rigid plate member when said first rigid plate member is in the generally vertical position;

said rigid plate pivotally mounted on said first rigid plate member and facing the center of the base when said first rigid plate member is in the generally vertical position; and a second resilient pad mounted on the surface of said rigid plate facing the center of the base.

15. The improved rack as set forth in claim 14 further including a pair of bottom edge supports pivotally and slideably mounted on the base in spaced relation to one another.

16. The improved rack as set forth in claim 15 further including:

a pair of standards, each standard comprising:

a tubular member having a first end and a second end;

means for pivotally mounting the first end to said base;

a rigid securing member slideably mounted in said first member, said rigid securing member in the first position extends out of said rigid member into engagement with the base and in the second position contained within said rigid securing member; and means operating on said rigid securing member for moving said rigid securing member from the first position to the second position.

17. The improved rack as set forth in claim 1 wherein said biasing means is a resilient pad between said rigid member and the base.

18. The improved rack as set forth in claim 1 wherein said biasing means comprises:

at least one guide rail means mounted on the base generally parallel to the backwall;

carriage means slideably mounted on said guide rail;

means for reciprocal movement of said carriage means in a first direction toward the center of the base and in a second direction opposite to the first direction;

said rigid member mounted on said carriage means;

means acting on said carriage means for moving said carriage means in a first direction to a selected one of a plurality of engaging positions and for moving said carriage means in the second direction; and means for dampening forces acting on said rigid member and said rigid plate as said carriage means moves in the first direction from the selected one of the plurality of positions.

19. The improved rack as set forth in claim 1 wherein the articles are made of glass.

* * * * *